US005191319A

United States Patent [19]

Kiltz

[11] Patent Number: 5,191,319

[45] Date of Patent: Mar. 2, 1993

[54] METHOD AND APPARATUS FOR VISUAL PORTRAYAL OF MUSIC

[76] Inventor: Richard M. Kiltz, 30028 SE. 208th, Maple Valley, Wash. 98038

[21] Appl. No.: 597,157

[22] Filed: Oct. 15, 1990

[51] Int. Cl.[5] ..... G09G 3/06

[52] U.S. Cl. ..... 340/701; 340/793; 340/815.1; 340/815.11; 84/464 R

[58] Field of Search ..... 340/701, 703, 766, 767, 340/793, 815.1, 815.11, 815.17, 825.25, 825.71, 825.77; 84/464 R; 362/231, 236, 252; 455/234, 239, 245, 250, 251, 234.1, 239.1, 245.1, 245.2, 250.1, 251.1, 253.2; 381/107, 108; 358/81

[56] References Cited

U.S. PATENT DOCUMENTS

| | | | |
|---|---|---|---|
| 2,340,559 | 2/1944 | Pruyn et al. | 340/701 |
| 3,924,231 | 12/1975 | McClure | 340/815.1 |
| 3,949,350 | 4/1976 | Smith | 362/231 |
| 4,056,805 | 11/1977 | Brady | 340/815.17 |
| 4,128,846 | 12/1978 | Robinson, Jr. | 358/81 |
| 4,259,709 | 3/1981 | Eddings | 362/231 |
| 4,376,404 | 3/1983 | Haddad | 84/464 R |
| 4,394,656 | 7/1983 | Goettsche | 84/464 R |
| 4,614,942 | 9/1986 | Molinaro | 340/815.11 |
| 4,713,658 | 12/1987 | Swinton | 84/464 R |
| 4,754,202 | 6/1988 | Havel | 340/815.1 |
| 4,768,086 | 8/1988 | Paist | 340/815.11 |
| 4,771,280 | 9/1988 | Molinaro | 340/815.11 |
| 4,790,629 | 12/1988 | Rand | 340/701 |
| 4,809,584 | 3/1989 | Forrest | 340/815.11 |

*Primary Examiner*—Alvin E. Oberley
*Assistant Examiner*—Richard Hjerpe

[57] ABSTRACT

Apparatus for translating audio signals and producing a visual color display that portrays music. Circuits responsive to audio signal amplitude cause the display brightness to vary in accordance with the loudness of the music source. Circuits responsive to audio signal frequency content cause the color of the display to vary in accordance with the frequency spectrum of the music source. The audio frequency spectrum is evaluated by circuits which divide the spectrum into multiple contiguous frequency bands without the use of traditional filtering techniques. A palette of preselected light colors is assigned to the frequency bands such that each band is displayed as a unique color. The display apparatus is comprised of multiple colored light sources enclosed within a curved translucent light diffusion globe. Light sources are activated singly or in combinations of two adjacent light sources to produce the most attractive color blending to appear on the surface of the globe.

6 Claims, 7 Drawing Sheets

FIG. 6

| FREQ. BAND –Hz | ACTIVE LIGHTS: WHITE | FUSCHIA | BLUE | GREEN | AMBER | RED | GLOBE COLOR |
|---|---|---|---|---|---|---|---|
| > 2500 | ON | | | | | | WHITE |
| 1650–2500 | | ON | | | | | FUSCHIA |
| 1250–1650 | | ON | ON | | | | PINK–VIOLET |
| 865–1250 | | | ON | | | | BLUE |
| 675–865 | | | ON | ON | | | BLUE–GREEN |
| 485–675 | | | | ON | | | GREEN |
| 390–485 | | | | ON | ON | | GREEN–YELLOW |
| 295–390 | | | | | ON | | AMBER |
| 250–295 | | | | | ON | ON | ORANGE |
| 200–250 | | | | | ON | ON | RED–ORANGE |
| < 200 | | | | | | ON | RED |

METHOD AND APPARATUS FOR VISUAL PORTRAYAL OF MUSIC

BACKGROUND OF THE INVENTION

1. Field of the Invention

This invention relates in general to visual displays and in particular to a visual display translated from musical sound.

2. Prior Art

The patent to Rand, U.S. Pat. No. 4,790,629, issued on Dec. 13, 1988, for Visual Display System With Triangular Cells, discloses a display consisting of a regular pattern of adjacent isosceles triangles which may be formed into numerous geometric shapes. Each cell contains four filament type light sources, color filters, and a flat translucent light diffusing surface. The triangular outline shape is formed by opague interior light baffles. The apparatus employs a digital information processor and storage tables to facilitate the storage of color and intensity values for each cell. A keyboard is provided whereby during operation a key closure will cause automatic execution of a preselected lighting effect to be produced.

The patent to Swinton, U.S. Pat. No. 4,713,658, issued on Dec. 15, 1987, for Apparatus For Providing A Visual Interpetation Of An Audio Signal, discloses means to electronically analyze a musical signal into components based on the frequency or amplitude characteristics of the signal. These component signals are used to operate electric motors and lamps. A motor rotates a primary shaft to which is attached multiple secondary motors and shafts which in turn rotate multiple decoratively shaped fin assemblies. The fin assemblies may be reflective or contain lighting means. The entire motor, shaft, and fin assembly is encased in a translucent sphere which may also rotate and include light reflective means.

The patent to Goettsche, U.S. Pat. No. 4,394,656, issued on Jul. 19, 1983, for Sound Display Apparatus Having Separation Control, discloses the use of multiple band pass filters to divide the audio frequency spectrum. A reference signal is derived from each of the band pass filters and subsequent envelope detectors which represents the average value of the multiple frequency limited signals. Each of the frequency limited signals is compared to the reference signal and lamp selection occurs for each frequency limited signal that exceeds the reference signal. Means are also provided for supplying a varying signal to the reference signal to cause the reference signal to cyclically vary about the average value. As sound level varies, the cyclic reference signal variation alters lamp illumination time to cause lamp brightness to change in accordance with sound level.

The patent to Haddad, U.S. Pat. No. 4,376,404, issued on Mar. 15, 1983, for Apparatus For Translating Sound into a Visual Display, dicloses the use of filters to separate electrical audio signals into a plurality of discrete tones within the audio range. A logic circuit is used to select the highest frequency tone to illuminate one of a plurality of colored lamps. The intensity of the selected lamp is regulated by a voltage representing the amplitude envelope of the audio signal as modified by an automatic level control circuit. An automatic level control circuit is also used to modify the audio electrical signal from which the above mentioned tones are derived by means of tone detectors. Similarly, a low band pass filter and automatic level control circuit are used to derive a beat signal pulse to fluid valves for pulsating liquid discharge representing the rhythm of the sound source.

The prior art relies on electrical filtering techniques to divide the audio frequency spectrum into components for display, various logical criteria to determine color selection, electromechanical devices to portray a sense of movement, and direct lamp illumination, reflective media, or diffusing media to display lighting effects. The purpose of such apparatus is to enhance the enjoyment of music listening by the addition of a visual impression of the music. In view of the subtlety of great classical music, or of popular music, refinement of visual interpretation is of utmost significance. Yet, electrical filtering techniques are incapable of precisely uniform frequency representation across the spectrum segment of interest. Also, mechanical contrivances for producing a sense of motion tend to produce and element of artificiality rather than an aesthetically pleasing portrayal of music. The prior art is therefore, at best, crude in its visual interpretation of music and there is much opportunity for refinement.

Accordingly, it is a principal object of the present invention to achieve precise frequency division without unwanted band edge effects and to produce an interesting visual display sensitive to small variations in loudness, frequency content, and time related effects in music. It is another principal object of the present invention to be capable of sufficiently inexpensive implementaton for home use by individuals, as well as to be practical for public display purposes.

SUMMARY OF THE INVENTION

In fulfillment and implementation of the previously recited objects, a primary feature of the invention resides in a unique electronic arrangement to convert the audio frequency spectrum into a single voltage whose amplitude is representative of all frequency components present. Said voltage is utilized to select the display color from a palette of predetermined visually attractive colors. The brightness of the display is in accordance with the amplitude of the audio envelope. Both color and brightness visual characteristics respond to the respective audio characteristics over the full range of melodic and rhythmic frequencies and the loudness of music. In the preferred embodiment of the invention, the visual display means comprise a plurality of independently controlled colored light sources within a spherical shaped diffusion globe that blends multiple internal light colors into an external resultant color of the entire spherical surface. The appearance of the display globe when illuminated with these preselected colors is both unusual and interesting. Subtle shades of color and variations in brightness, both of which vary in time with the dynamics of the music source, convey an aesthetically pleasing sense of the music composition. The visual effect of the curved globe and multiple light sources produces a sense of the movement of the music as in a three-dimensional-presentation All components and materials needed for a preferred embodiment of this invention are of a non-specialized nature and are readily obtainable. Electromechanical devices are not utilized and there are no moving parts required.

BRIEF DESCRIPTION OF THE DRAWINGS

FIG. 6 is a table which correlates audio frequency bands, colored lights, and the resultant overall display color

DETAILED DESCRIPTION

Figure 1:
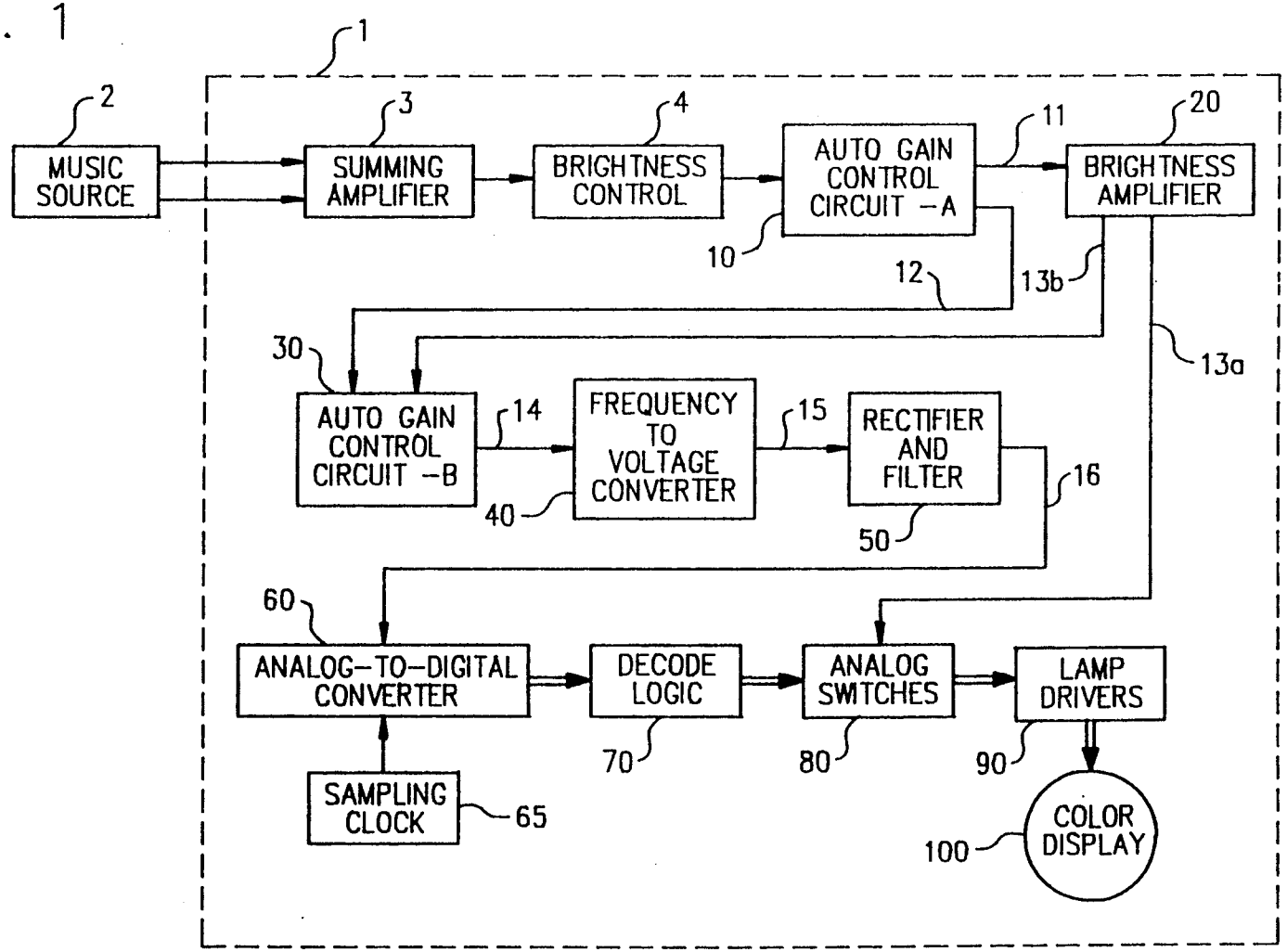
FIG. 1 is a block diagram of apparatus for visual portrayal of music embodying the present invention.

Refer now to FIG. 1, which is an overall block diagram of a preferred embodiment of the invention. The following discussion describes the general function of the apparatus 1 as presented in FIG. 1. Subsequently, more detailed discussion will break down the operation of each block in FIG. 1 to the schematic level.

The apparatus 1 receives electronic signals from a music source apparatus 2. This music source 2 typically comprises a stereo receiver, speakers or earphones, cassette player, compact disc player, or other means by which audio information is translated into electronic signals. These signals should be of high quality such that the noise level contained therein is very small compared to the level of music information represented. The apparatus of this invention 1 is very sensitive to the signals of the music source 2 such that unwanted noise may contaminate the visual color display 100.

The summing amplifier 3 combines the electronic signals from the music source 2 into a single signal which advances to the brightness control 4. The brightness control 4 provides a means for manual adjustment of the brightness level of the color display 100 to be commenserate with the loudness level of sound produced by the music source 2. Brightness control 4 is adjusted such that the softest audible music passages are just perceptable in the color display 100.

The signal advances from the brightness control 4 to the auto gain control circuit 10 which operates to compress the dynamic amplitude range of the audio signal by automatic means. While the brightness control 4 adjustment establishes an overall average amplitude level, the auto gain control circuit 10 acts on a continuous basis to limit amplitude variations about the average level. The operation of circuit 10 keeps the audio amplitude levels within a useful range for subsequent apparatus that control light brightness.

The audio output from circuit 10 proceeds on plural paths to brightness amplifier 20 and auto gain control circuit 30. Signal path 11 to brightness amplifier 20 is the dc voltage envelope of the audio signal produced by rectification and filtering operations within circuit 10. Signal path 12 is an ac voltage containing all of the audio frequency components of the input from summing amplifier 3. Signals 11 and 12 both have a compressed amplitude envelope due to the function of circuit 10.

Brightness amplifier 20 provides voltage and power gain to feed multiple lamp drivers 90 through multiple analog switches 80. An output signal, **13*b* from amplifier 20 also feeds into auto gain control circuit 30**.

Auto gain control circuit 30 operates on signal 12 in a manner similiar to that of auto gain control circuit 10. However, the purpose of circuit 30 is to control the gain to such an extent that the output signal 14 is substantially independent of amplitude variation. Signal **13*b* is operated upon by circuit 30 to augment the normal auto gain function and produce an output ac signal 14 with a preselected constant envelope amplitude. Thus, signal 14 contains all the frequency components present in the audio signal from summing amplifier 3**. Also, the amplitude of all frequency components are in the same relative proportion to each other. However, the sum of all frequency component amplitudes is a constant level over the useful amplitude range.

Frequency-to-voltage converter 40 operates on signal 14 to produce an ac voltage output signal 15 which is proportional to the frequency content of signal 14. For example, an audio frequency component "a" having a frequency twice as great as the frequency of another component "b" and the same amplitude as "b" will be represented at the output of converter 40 with twice the amplitude of "b". Both component signals "a" and "b" will be represented in signal 15 at the same frequency as they were in signal 14 prior to conversion.

Rectifier and filter 50 operate on signal 15 to produce a dc voltage output which is the amplitude envelope of signal 15. Amplitude envelope signal 16 then feeds into the analog-to-digital converter 60 which operates at a fixed rate, as determined by the sampling clock 65, to produce a digital representation of the amplitude envelope signal. Multiple binary signals then proceed from the converter 60 output to the decode logic 70.

It should be noted that signal 16 contains a single value measurement of the audio frequency spectrum at any given instant of time. All frequencies in the audio spectrum are evaluated such that each component contributes exactly in accordance with its particular amplitude and frequency characteristic. Thus, in music with a complex frequency spectrum containing many simultaneous components, an exact single value measurement characterizes the entire audio spectrum at each instant of time.

Decode logic 70 operates on the multiple binary signal from 60 to divide the audio frequency spectrum represented by these signals into a plurality of contiguous frequency bands. Thus, audio spectrum division is achieved without the use of a plurality of band-pass filters.

Decode logic 70 produces multiple binary output signals each of which represents one selected band of frequencies from the audio spectrum. These output signals feed into analog switches 80. Analog switches 80 are controlled by the signals from the decode logic 70 to connect the audio amplitude envelope signal **13*a* to a plurality of signal paths into the lamp drivers 90**.

The lamp drivers 90 provide for selectively activating a plurality of colored light sources contained within the color display 100. Each lamp driver controls the brightness output of a single light source in accordance with the audio amplitude envelope signal **13*a* and the audio frequency band selected by the decode logic 70. Analog switches 80 are arranged to cause activation of one or more lamp driver circuits 90 according to a preselected assignment of light color to each audio frequency band defined by the decode logic 70**.

Color display 100 is comprised of mounting means for a plurality of colored light sources and a spherical shaped diffusion globe, the light sources, and the globe which encloses the light sources. The light sources are arranged in a circular equally spaced array near the center of the globe. The diffusion surface of the globe is translucent and will illuminate when any light source is activated such that the entire external surface of the globe appears as an independent light source.

More than one interior light source may be activated at the same time to produce a resultant color on the exterior surface of the globe. This resultant color is a blending of the different colors of the multiple activated internal light sources. Thus, the exterior surface of the globe appears to be illuminated with a single color that differs from each of the activated interior light sources.

In the preferred embodiment of this invention, the interior light sources are arranged in the same general color order as the natural spectrum of white light. This natural order is: red-orange-yellow-green-blue-violet (or purple). Thus, for example, the green light source would be mounted in an adjacent position to the yellow and blue light sources. The assignment of color to audio frequency band is such that red corresponds to the lowest frequency band, a shade of orange to the next higher frequency band and so on through the palette of available light source colors. Only one or two adjacent light sources are illuminated at the same time in the preferred embodiment of this invention.

Figure 2A:
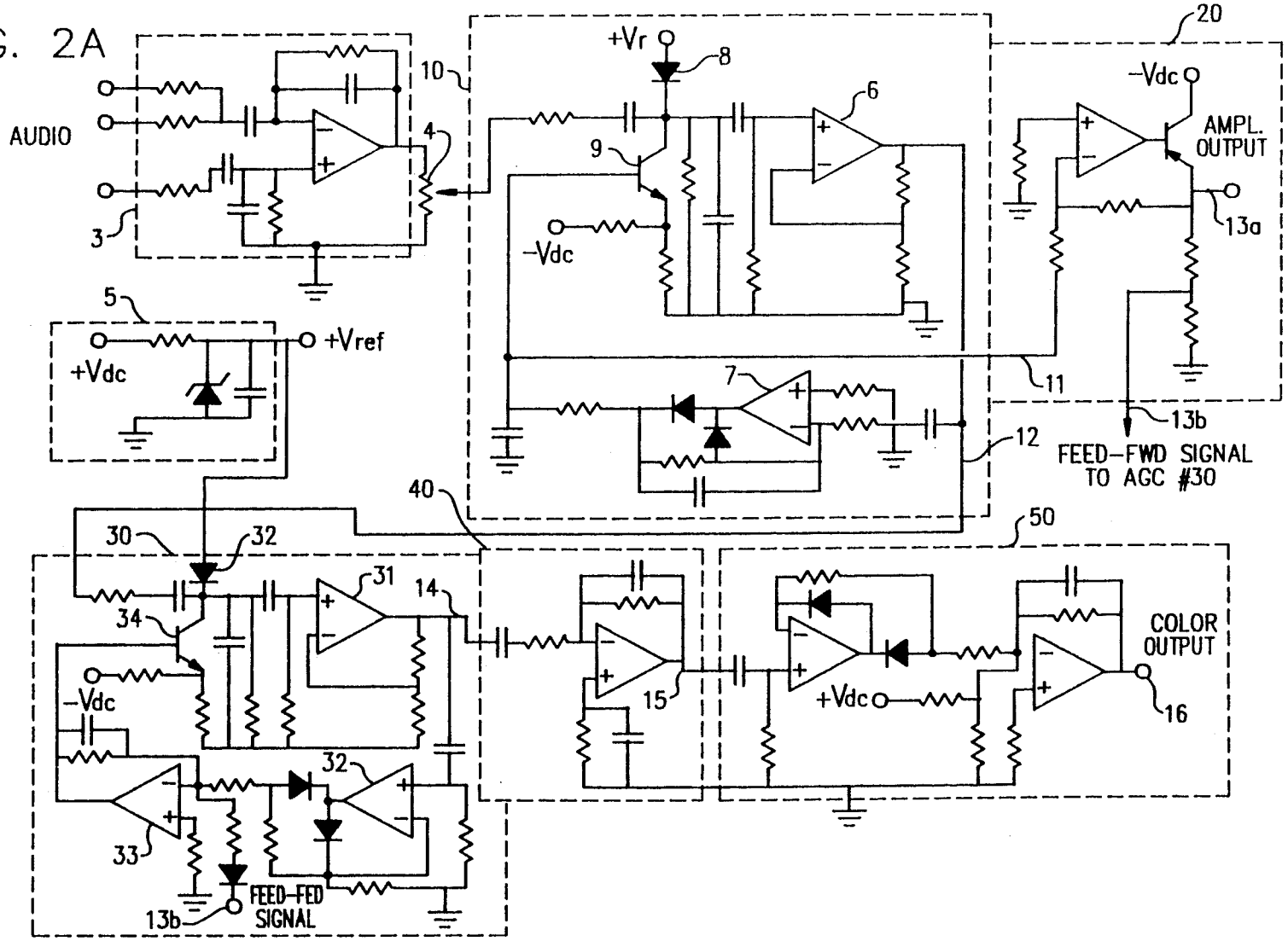
FIG. 2A is a schematic diagram of circuitry for deriving brightness and color envelope voltages.

Refer now to FIG. 2A, which is a schematic diagram of circuitry for deriving brightness and color envelope voltages in a preferred embodiment of the invention. The circuit paths shown in FIG. 2 are generally responsive over the frequency range of 20 to 20,000 hert. However, the frequency band used for visual display extends from approximately 30 to 4000 hertz.

The summing amplifier 3 sums the left and right stereo ac voltage inputs and filters the resultant sum signal through a low pass filter with a corner frequency of 4000 hertz. These functions are accomplished with an operational amplifier connected in a well known configuration for these purposes.

The resultant output signal from amplifier 3 is then attenuated through the brightness control potentiomenter 4 and feeds into the auto gain control circuit 10. Circuit 10 is connected in a known configuration for the function of automatic-gain-control. The dc bias current through diode 8 is controlled through transistor 9 and the rectification and filtering components of operational amplifier 7. The dc current through diode 8 is thus directly proportional to the output voltage envelope from amplifier 6. The nonlinear characteristic of the diode results in an impedance variation which attenuates the ac audio signal from brightness control 4. Thus, the ac signal at the input of operational amplifier 6 is attenuated in accordance with the amplitude of the ac signal at the output of amplifier 6. Operational amplifier 7 with the rectification and filtering components connected to its output provide the dc feedback into transistor 9 for automatic gain control and this same signal 11 feeds into the brightness amplifier 20. The ac output of operational amplifier 6 feeds into amplifier 7 and the auto gain control circuit 30. The resistors connected to the emitter of transistor 9 bias the transistor such that very small voltage output from amplifier 7 will start current flow through the collector of 9. The resistor and capacitor values at the output of amplifier 7 are selected to provide minimal lag in automatic gain response while perserving the loop stability of circuit 10.

Circuit 5 uses a zener diode and filtering components to provide a reference voltage that isolates the diodes 8 and 35 in circuits 10 and 30 from unwanted electrical noise.

Circuit 20 amplifies the dc envelope signal 11 from circuit 10 providing voltage and power gain. The operational amplifier and transistor are configured in a well known manner for this purpose. The output from the emitter of the transistor, signal **13*a* feed into the analog switches 80. A resistive divider connected to the emitter of the transistor provides a reduced voltage output signal 13*b* which feeds into circuit 30**.

Auto gain control circuit 30 operates similarly to circuit 10 with the exception that signal **13*b* is added into the dc feedback loop of circuit 30. In circuit 30, components 34, 35 and 31 operate on the compressed ac input signal 12 in the same manner as 9, 8 and 6 in circuit 10. Operational amplifier 32 and the diodes connected to its output perform the known envelope detection function. This envelope dc voltage signal then feeds into operational amplifier 33 as does the signal 13*b*. Amplifier 33 sums these two signals and provides the low pass filtering function for envelope detection. The low pass filter time constant is approximately 1.2 seconds. The output of amplifier 33 then feeds into the base of transistor 34 to control diode 35 current and thus the gain of circuit 30**.

The effect of adding signal **13*b* is to permit control of the ac signal gain such that the output of amplifier 31 maintains a constant envelope value containing only slight loudness variations present in the audio signal. The effect of two auto gain control circuits 10 and 30 operating in series is also an appreciable factor in attaining an audio signal 14** virtually devoid of amplitude variation, but with the frequency content unaltered.

Figure 2B:
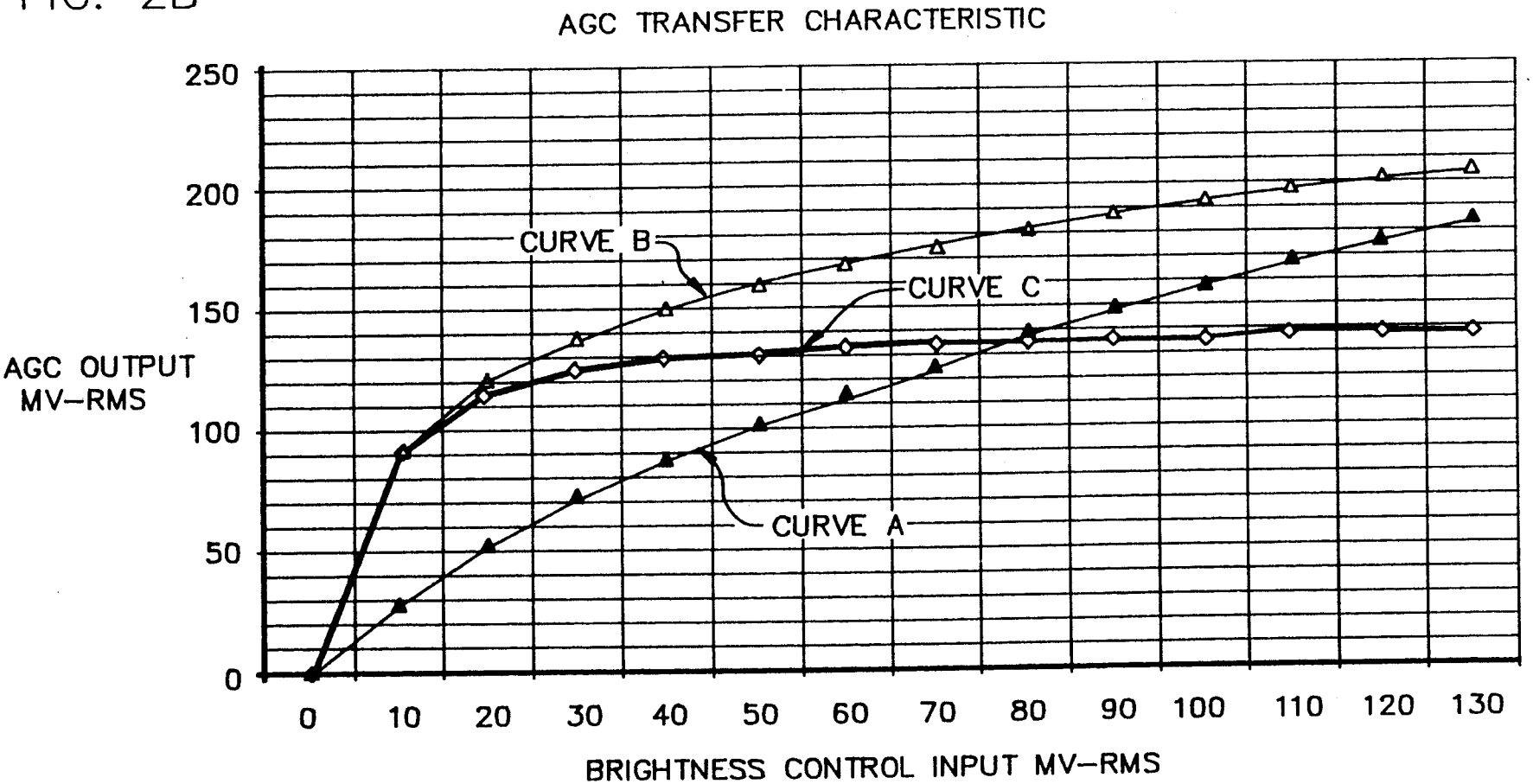
FIG. 2B is a graph showing transfer characteristics of the automatic gain control circuits.

Refer to FIG. 2B which shows a graph of the transfer characteristic of the two auto gain control circuits. In FIG. 2B, the vertical axis scale corresponds to the ac voltage amplitude of signals 12 and 14 and the horizontal axis scale to the ac voltage input to circuit 10 from the brightness control 4. Curve 'A' represents the transfer characteristic of auto control circuit 10, curve 'B' is the combined characteristic of circuits 10 and 30 in series without signal **13*b*, and curve 'C' is the combined characteristic (i.e. signal 14) with signal 13*b*** present. It can be seen that curve C is extremely flat over most of the input amplitude range.

Referring now to FIG. 2A, frequency-to-voltage converter 40 consists of a single operational amplifier configured in a known manner to produce a transfer characteristic in which the output amplitude is directly proportional to the input signal frequency. The output signal 15 of converter 40 is an ac signal whose envelope voltage is a single value measurement of audio frequency content.

Signal 15 feeds into rectifier and filter circuitry 50. In circuit 50, two operational amplifiers perform the known functions of envelope detection and smoothing through a low pass filter. The resistive divider to the output amplifier stage biases the amplifier to eliminate offset at very low signal levels. The time constant of the output filter approximately 68 milliseconds. The output signal 16 from circuit 50 is a dc voltage representing the instantaneous frequency content of the audio spectrum and therefore is used to determine the color of the visual display 100.

Figure 3:
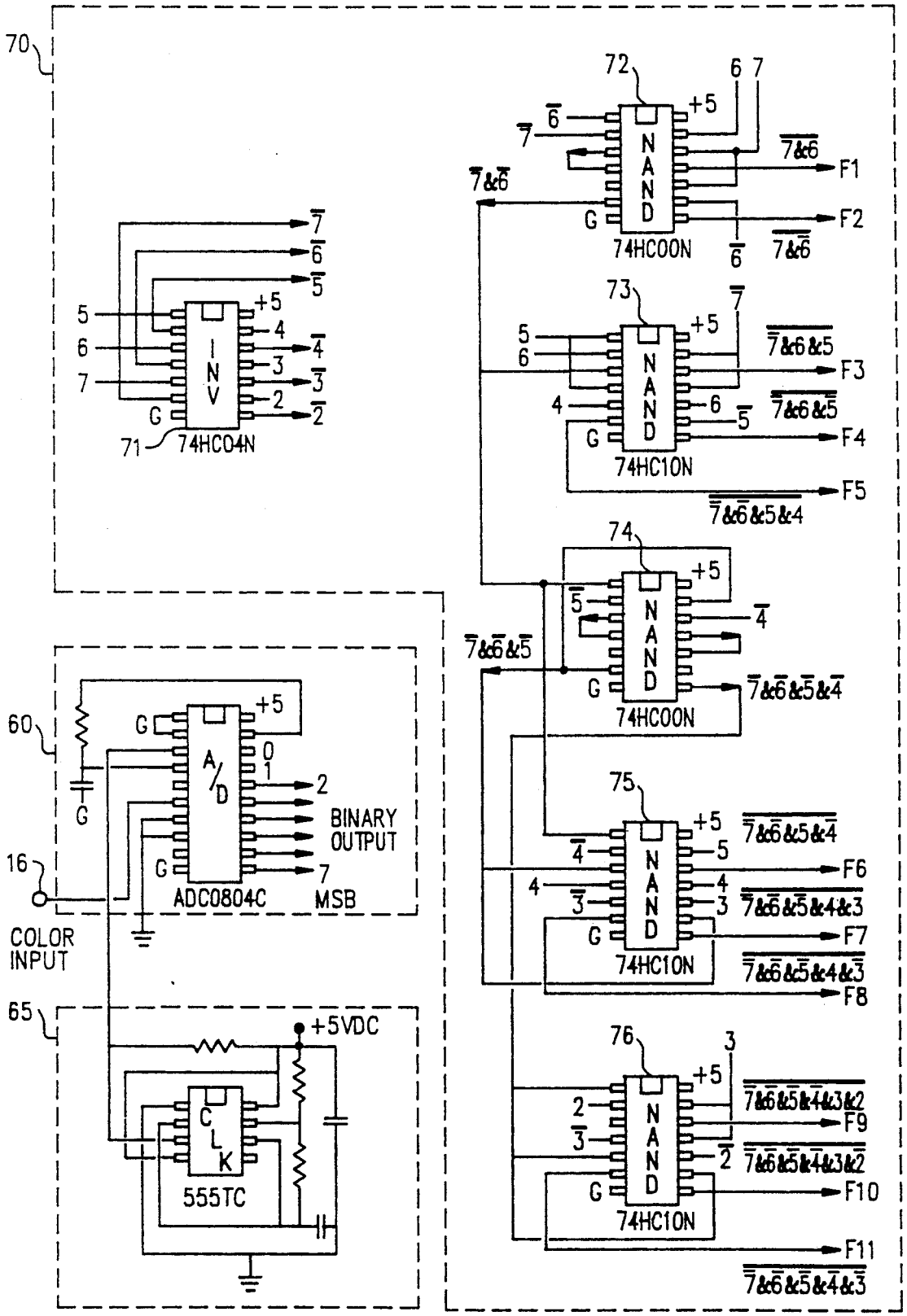
FIG. 3 is a schematic diagram of the analog-to-digital converter, sampling clock, and decode logic.

Refer now to FIG. 3, which is a schematic diagram of the analog-to-digital converter 60, sampling clock 65, and decode logic 70 in a preferred embodiment of the invention. In FIG. 3, the major circuit components are integrated digital logic circuits of a well known type. The component type numbers are indicated and Boolean logic equations are shown for the output and various intermediate signals of the decode logic 70 in FIG. 3.

Signal 16 feeds into analog-to-digital converter 60. A well known type of integrated circuit on a single chip is used for this conversion. Similarly a known single chip integrated circuit 65 is used to provide a sampling pulse to the converter. Circuits 60 and 65 operate according to well known principles to convert signal 16 into a plurality of binary signals 0 through 7. In the preferred embodiment of this invention an 8 bit analog-to-digital converter chip is used and the most significant six of the binary output signals are fed on into decode logic 70. It will be apparent to one skilled in the art that a larger A/D converter can be readily employed to achieve any desired resolution in the digital representation of the color signal 16.

Binary outputs 2 through 7 from A/D converter 60 feed into an inverter logic chip 71 containing six inverter circuits. The outputs 2 through 7 from the inverter 71 and outputs 2 through 7 from the A/D converter 60 feed into a plurality of NAND gates contained in integrated logic components 72, 73, 74, 75 and 76. Each of the components 73, 75 and 76 contains three, three input NAND gates. Components 72 and 74 each contains four, two input NAND gates. The decode logic 70 performs the function of determining the desired audio frequency bands from the binary information provided by the A/D converter 60. Therefore the decode logic 70 outputs, F1 and F11, are binary signals that take on a low state during the time that the color signal 16 indicates that the audio frequency content is within a preselected frequency band.

In the preferred embodiment, eleven frequency bands are selected as follows:

(a) signal F1; greater than 2500 hertz
(b) signal F2; 1650 to 2500 hertz
(c) signal F3; 1250 to 1650 hertz
(d) signal F4; 865 to 1250 hertz
(e) signal F5; 675 to 865 hertz
(f) signal F6; 485 to 675 hertz
(g) signal F7; 390 to 485 hertz
(h) signal F8; 295 to 390 hertz
(i) signal F9; 250 to 295 hertz
(j) signal 10; 200 to 250 hertz
(k) signal F11; less than 200 hertz These eleven binary output signals, F1 through F11, from decode logic 70 feed into the analog switch circuits 80 which determine the color of the display. It will be apparent to one skilled in the art that, at the expense of additional logic components, a greater quantity of frequency bands could be defined using the same technique. Similarly, the frequency band ranges can be selected at different values.

Figure 4:
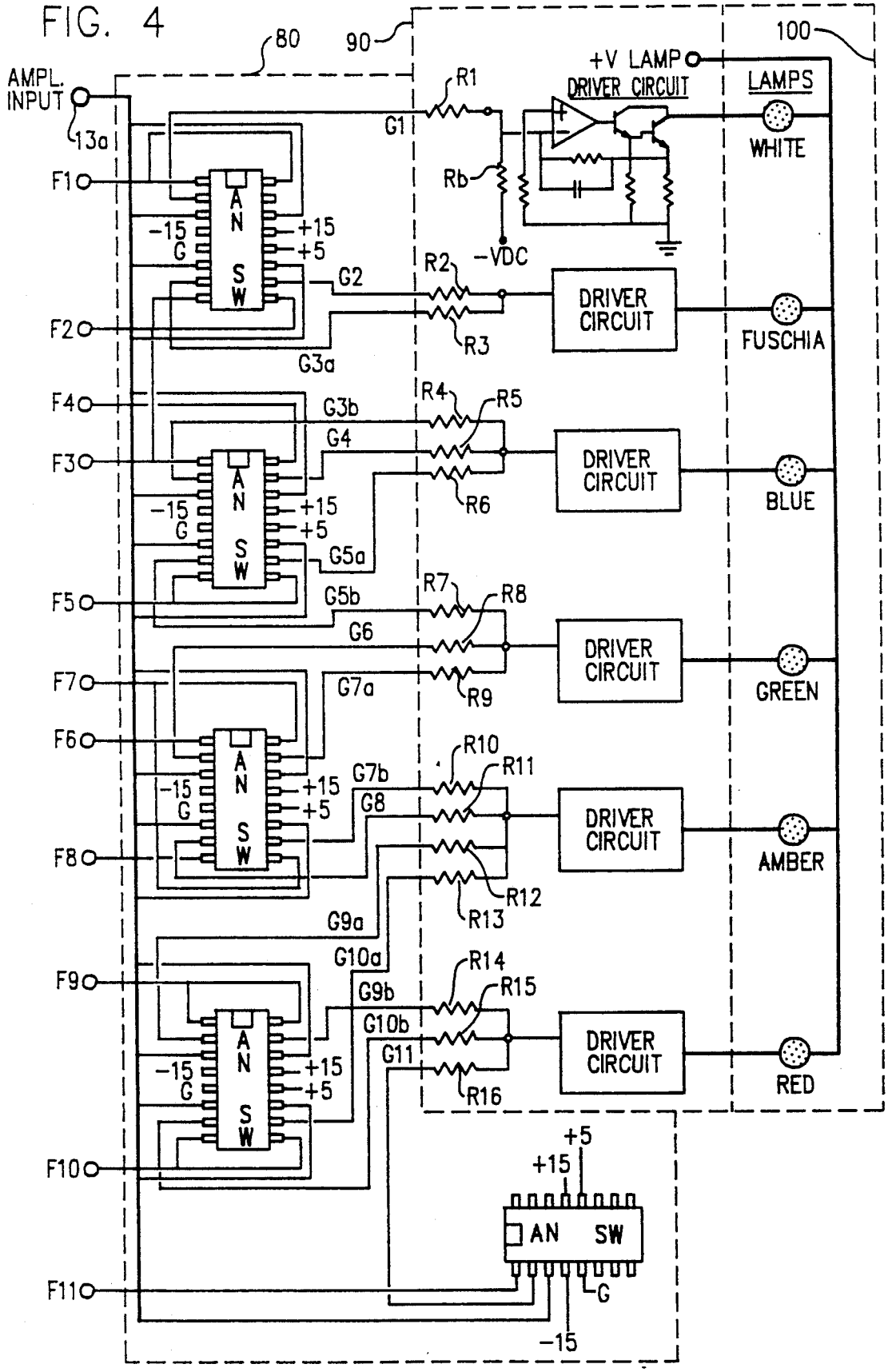
FIG. 4 is a schematic diagram of the analog switches and lamp drivers.

Refer now to FIG. 4, which is a schematic diagram of the analog switches 80 and lamp drivers 90 is a preferred embodiment of the invention. In FIG. 4, the analog switches 80 consist of five identical integrated circuits known as "quad SPST CMOS, analog switches", type DG 211. Each component contains four identical switch circuits. Each switch is caused to operate in accordance with the decode logic signals F1 through F11. One or two analog switches are controlled by each decode logic signal F1 through F11. Operation of any analog switch causes an isolated connection of the audio amplitude signal 13*a* to one of the resistor inputs to lamp drivers 90. The analog switch 80 output signals, designated G1 through G11 are the connections which feed into the lamp driver circuits 90. Thus when control signal F1 is active, audio amplitude signal 13*a* is connected through one analog switch circuit to activate signal G1 which causes the white lamp to turn-on with a brightness determined by signal 13*a* and the value of the resistor R1. When control signal F3 is active, signal 13*a* is connected through two analog switches activating signals G3*a* and G3*b* to turn-on the fuschia and blue lamps. It can be seen from FIG. 4 that only one or two adjacent lamp driver circuits are activated at the same time because only one control signal, F1 through F11, can be active at the same time.

The lamp driver circuits 90 consist of six identical driver circuits and a set of resistors, R1 through R16, connected to each driver circuit. The resistor values R1 through R16, are selected to establish the desired brightness of each lamp for every analog switch signal that can activate a given lamp. Thus, when two lamps are illuminated at the same time, these resistors are used to adjust the gain of the two related driver circuits to achieve the desired color blend.

The driver circuits are comprised of an operational amplifier and two transistors which operate in a well known manner to precisely establish the current flow through each lamp. The value of lamp current is determined by the amplitude of signal 13*a* and the value of the selected input resistor, R1 through R16. Each driver circuit contains a low-pass filter to smooth the amplitude signal 13*a* and the effects of switching transients. This filter time constant is approximately 0.1 seconds. Resistor Rb is used in each driver circuit to establish a quiesent lamp current just sufficient to cause a faint filament glow in the lamp. A separate power supply is used to provide the dc lamp current.

Figure 5A:
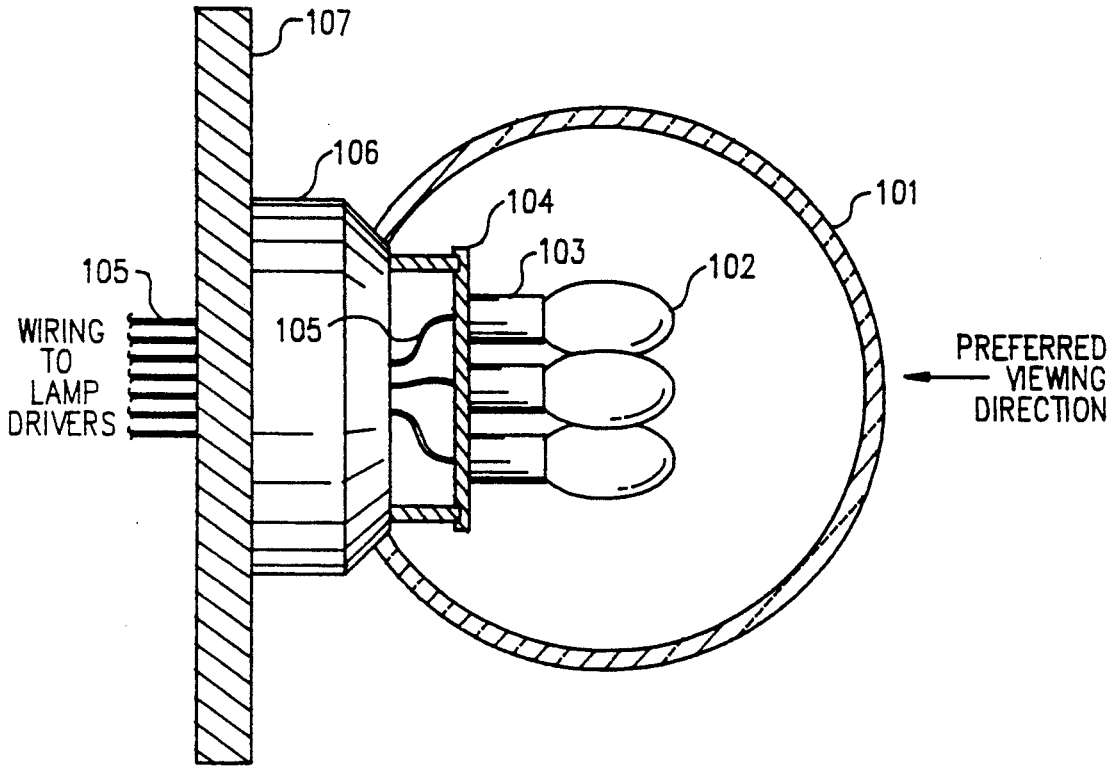
FIG. 5A and FIG. 5B are profile and front views of the color display apparatus.
Figure 5B:
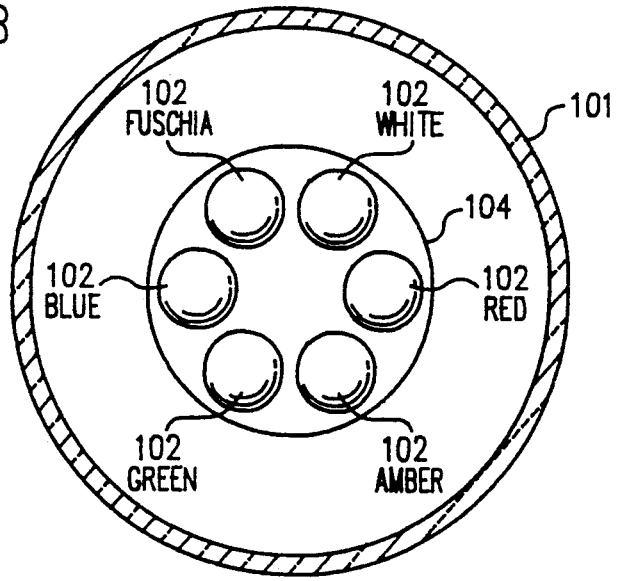

Refer now to FIG. 5A and FIG. 5B which are drawings of the display apparatus 100 in a preferred embodiment of the invention. The display apparatus 100 is comprised of a curved light diffusion surface 101, a plurality of colored lights 102, light sockets 103, a light socket mounting bracket 104, wiring for each light socket 105, a mounting base 106 and a vertical surface 107 to which base 106 is attached.

In the preferred embodiment, the light diffusion surface 101 is a spherical globe which encloses six colored lights. The globe 101 may be of the type that are manufactured for use in household or outdoor lighting fixtures and sometimes referred to as opalized glass. Such globes are translucent white in color, and will glow uniformly over the exterior surface when lighted from within.

The colored lights 102 may be implemented by the use of color filters in conjunction with white or clear light bulbs or colored light bulbs may be obtained. For example, colored lights manufactured for Christmas tree decorations in the five to seven watt size may be suitable for this display purpose. Light colors should be selected as closely as possible to match the deeply saturated hues represented in the spectrum of sunlight. The number of independent light sources 102 used is largely determined by the availability of suitable light colors and the relative size of the light bulbs to the dimensions of the globe 101.

In the preferred embodiment, six independent, filament type, colored lights are used. The lights 102 are arranged in a tightly grouped circular pattern near the center of the spherical globe 101 as shown in FIG. 5.

Mounting bracket 104 holds the lamp sockets 103 in the proper spacial relationship to the globe and bracket 104 is attached to the mounting base 106. Mounting base 106 secures the globe 101 and holds the bracket 104 in proper spacial relationship to globe 101. Mounting base 106 attaches to a vertical surface 107 which has an opening to permit wires from each lamp socket to pass through to make connection with lamp driver circuits 90. The vertical surface 107 could be the facing surface of a cabinet used to contain the necessary electronic apparatus, as well as to mount the display assembly.

Refer to FIG. 6 for a table correlating the audio frequency bands, the colored lights 102 and the resultant overall color of globe 101. The appearance of the display globe 101 when illuminated with these colors is both unusual and interesting. Though the globe is uniformly lighted, the location of the interior activated light source is discernable as well as shadows from nonactivated interior light bulbs. The combined effect of these factors within the spherical shape of the globe is aesthetically pleasing and produces a subtle subjective sense of the movement of the music as in a three-dimensional presentation.

The purpose of illuminating only one or two adjacent lights at one time, as shown in FIG. 6, is to avoid color combinations which will tend to shift the resultant globe color towards white. This lightening of color is generally not as pleasing as a saturated color. Since adjacent mounted lights are also selected to be adjacent in the spectral color chart, the lightening effect caused by two adjacent lights is minimal.

It will be apparent to one skilled in the art that numerous implementation variations are possible using the principles disclosed in this detailed description. For example, more or less frequency bands and/or light sources can be utilized to display many different colors with a different correlation to the audio frequency spectrum. Also, different shapes of diffusion surfaces could be used to enclose the light sources and the light sources could be other than filament type lamps.

The foregoing description of the preferred embodiment of the invention has been presented for the purposes of illustration and description. It is not intended to be exhaustive or limit the invention to the precise form disclosed. Many modifications and variations are possible in light of the above teaching. It is intended that the scope of the invention be limited not by this detailed description, but rather by the claims appended hereto.

I claim:

1. Apparatus for translating sound into a visual display, said sound comprising a band of frequencies in the audio spectrum over which appear the rhythmic and melodic characteristics of music, said apparatus comprising:

(a) visual color display means;

(b) means to receive and control the amplitude of audio signals to cause said display brightness to vary in accordance with audio signal amplitude;

(c) gain control means responsive to said sound in the audio spectrum, whereby a frequency dependent signal is produced that is substantially independent of audio amplitude variation;

(d) frequency conversion means responsive to said frequency dependent signal, whereby all frequency components present in said frequency dependent signal are evaluated collectively and a single derivative signal having the same frequency components is produced whose amplitude is caused to vary in direct proportion with the total frequency content of said frequency dependent signal over the entire band of frequencies that include the rhythmic and melodic characteristics of music;

(e) amplitude conversion means responsive to said derivative signal and producing a plurality of discrete signals which denote the amplitude of said derivative signal relative to preselected amplitude threshold values;

(f) switching means responsive to said plurality of discrete signals to cause selection of color in said visual display.

2. The apparatus of claim 1, wherein said gain control means is comprised of two auto gain control circuits such that an ac output of the first auto gain control circuit is connected to an ac input of the second auto gain control circuit and a portion of a dc envelope signal from the first auto gain control circuit is summed into a dc envelope signal of the second auto gain control circuit.

3. The apparatus of claim 1, wherein said amplitude conversion means is comprised of an analog-to-digital converter which converts said derivative signal into a digital amplitude value and decode logic circuits which translates said digital amplitude value into a set of discrete signals, each of which designates a preselected frequency band segment within the audio spectrum.

4. Apparatus for translating sound into a visual display, said sound comprising a band of frequencies in the audio spectrum over which appear the rhythmic and melodic characteristics of music, said apparatus comprising:

(a) visual color display means;

(b) amplitude control means responsive to said sound in the audio spectrum, whereby audio signals are received and the amplitude adjusted;

(c) a first automatic gain control means responsive to said amplitude control means, whereby the dynamic amplitude range is compressed and a compressed amplitude signal is produced;

(d) brightness control means connected to said first automatic gain control means and causing said color display brightness to vary in accordance with said compressed amplitude signal;

(e) a second automatic gain control means connected to the output of said first automatic gain control means and producing a second compressed amplitude signal which is further compressed so as to be substantially independent of audio amplitude variation;

(f) frequency evaluation means connected to said second automatic gain control means and responsive to said second compressed amplitude signal to produce a set of discrete signals, each of which denotes a specific frequency band segment in said audio spectrum;

(g) switching means responsive to said discrete signals to cause selection of color in said visual display.

5. The apparatus of claim 4 wherein said second automatic gain control means further receives a portion of a d.c. envelope signal from said first automatic gain control means which is summed into a d.c. envelope signal of said second automatic gain control means.

6. Visual color display apparatus responsive to electronic signals that translate sound energy in the audio spectrum comprising:

(a) visual color display means;

(b) gain control circuit mens responsive to said electronic signals in the audio spectrum that produce a frequency dependent signal which is substantially independent of amplitude variation;

(c) a frequency-to-amplitude conversion circuit connected to said frequency dependent signal which collectively evaluates all frequency components present in said frequency dependent signal such that a single derivative signal having the same frequency components is produced whose amplitude is directly proportional with the total frequency content of said frequency dependent signal;

(d) an analog-to-digital conversion circuit connected to said single derivative signal and producing a plurality of binary signals which are collectively the digital representation of the amplitude value of said single derivative signal;

(e) decode logic circuits connected to the plurality of binary signals produced by said analog-to-digital conversion circuit and producing set of discrete signals, each of which designates contiguous frequency band segments within the audio spectrum;

(f) switching circuits connected to said set of discrete signals which cause activation of one or more colored light sources in accordance with said contiguous frequency band segment designated by said decode logic circuits.

* * * * *